United States Patent [19]

Anthonsen et al.

[11] Patent Number: 4,844,777

[45] Date of Patent: Jul. 4, 1989

[54] WATER-RESISTANT PHOTOGRAPHIC PAPER SUPPORT

[75] Inventors: Reiner Anthonsen, Bramsche; Ferenc Kertész; Wieland Sack, both of Bissendorf, all of Fed. Rep. of Germany

[73] Assignee: Felix Schoeller GmbH & Co., KG, Osnabruck, Fed. Rep. of Germany

[21] Appl. No.: 899,971

[22] Filed: Aug. 25, 1986

[30] Foreign Application Priority Data

Sep. 4, 1985 [EP] European Pat. Off. ..... 85 111 135.1

[51] Int. Cl.[4] ..... D21H 3/02

[52] U.S. Cl. ..... 162/135; 162/136; 162/158; 162/168.1; 162/181.2; 162/181.3; 427/391; 427/395

[58] Field of Search ..... 162/135, 136, 158, 181.2, 162/181.3, 168.1, 192; 427/395, 391

[56] References Cited

U.S. PATENT DOCUMENTS

| | | | |
|---|---|---|---|
| 3,615,795 | 10/1971 | Schulwitz et al. | 162/158 |
| 3,630,830 | 12/1971 | Herdle et al. | 162/158 |
| 4,133,688 | 1/1979 | Sack | 162/158 |
| 4,419,433 | 12/1983 | Kubbota et al. | 162/158 |
| 4,504,576 | 3/1985 | Kemme | 162/158 |
| 4,659,430 | 4/1987 | Tamagawa et al. | 162/158 |
| 4,665,014 | 5/1987 | Katsura | 162/158 |

*Primary Examiner*—Peter Chin

*Attorney, Agent, or Firm*—Lockwood, Alex, FitzGibbon & Cummings

[57] ABSTRACT

There is described a water-resistant paper support for photographic layers with at least one coating hardened by electron beams, in which the base paper of the paper support contains at least one aluminum compound in a quantity, relative to the aluminum ion, of 1 to 12 kg/t of cellulose, preferably 3 to 6 kg/t of cellulose, and with a pH-value of the paper stuff of the base paper between 5 and 8.

13 Claims, No Drawings

WATER-RESISTANT PHOTOGRAPHIC PAPER SUPPORT

The invention concerns a water-resistant paper support for photographic layers with at least one coating hardened by electron beams.

Water-resistant coated photographic paper supports are known in various forms. In particular, papers which are provided with extruded polyolefin layers have found wide application.

In U.S. Pat. Nos. 4,384,040, 4,364,971, as well as U.S. Pat. No. 4,554,175, paper supports are described which comprise base paper with at least one coating produced in situ with the help of electron beam hardening.

The coating hardened by electron beams has improved characteristics in comparison with the polyolefin coatings, which are documented in the increase in scratch-resistance; increase in pigment receptivity and a smooth surface. It is, like the poloyolefin coating, stable against photographic process solutions, and thus protects the paper supports positioned under it decisively against the penetration of these solutions, and shortens the length of the process. The resin coatings hardened by means of electron beams can contain pigments, coloring substances, optical brighteners, image stabilizers, anti-oxidants, or other additives, in so far as this is desirable or necessary in regard to the desired properties of a superimposed photographic image.

The photographic layers are, after a suitable preliminary treatment of the resin surface, applied to the resin layer, either directly or after prior application of an intermediary layer which facilitates adhesion. These photographic layers are preferably such layers as are known from the concept of silver halide photography, and which serve to produce black and white or color images.

So far it is a disadvantage for photographic papers with irradiation-hardened coatings that, during normal storage of the photographic products, a shift in the sensitivity of the photographic layers occurs and, during longer storage, a measurable fog occurs. It is as yet unclear why storage stability cannot be ensured, since the basic components have no measurable influence on the photographic layers.

This disadvantageous effect can be reduced by the application of barrier layers. DE-OS No. 30 46 130 describes the application of a polyolefin coating on the irradiation-hardened layer. By choosing this layer structure, however, the advantages of the coating hardened by electron beams are almost lost.

Another possibility of reducing the occurrence of fog is described in the German application No. P 3300025.5 in which a partial sealing of the paper support takes place through a polyolefin layer applied by extrusion, on which layer the coating which can be hardened by electron beams is applied. Although the advantages of the irradiation-hardened coatings remain, the occurrence of fog during longer storage periods is still not completely avoided.

It is thus the objective of the invention to create a water-resistance photographic paper support which is provided with at least one electron-beam hardenable synthetic resin layer, and which thereby possesses all the known advantages of the papers provided with these coatings, but which, even during longer storage time, exerts no influence on the sensitivity of the photographic layers which are placed on it, and which causes no chemical fog in the photographic layers.

The coating applied to one side and hardened by means of electron beams contains, in addition to the binding agent, preferably a pigment, and has a coating weight of 5 to 40 g/m$^2$ (preferably between 15 to 25 g/m$^2$).

The binding agent of the layer which can be hardened by electron beams essentially comprises such substances as contain, before hardening, C=C-double bonds in the form, for example, of acrylate or methacrylate groups.

The application of the hardenable mixtures takes place by using known coating processes in accordance, for example, with U.S. Pat. No. 4,364,971.

The back side of the paper can likewise be coated with a hardenable layer as well as other additional layers if necessary. In accordance with U.S. Pat. No. 4,364,971, the layers on both sides can also be applied in a single operation, and be solidified simultaneously.

The paper support is a photographic base paper and is hard sized with a hydrophobic internal size, which can be an emulsion of a so-called reactive sizing agent, particularly alkylkelenedimer. By sizing with reactive sizing agents, a considerable reduction of the penetration of the developing bath at the edges of the paper support during the photographic process is attained in comparison with acid sized paper supports which have a sizing with precipitated resin soaps or fatty acid soaps.

The base paper can have a basis weight of 100 to 250 g/cm$^2$ (preferably between 150 to 170 g/cm$^2$), and be produced exclusively from cellulose fibers or mixtures of cellulose fibers with synthetic fibers.

It can also, in addition to the reactive sizing agent, contain other known additives, such as, for example, wet strength agents, retention aids, white or color pigments, as well as optical brighteners.

The quantity of aluminum ions amounts to 1 to 12 kg/t (t=metric tons) of cellulose, preferably 3 to 6 kg/t of cellulose. Surprisingly the aluminum ions do not, as might be expected, negatively influence the degree of sizing, but in maintaining the pH-value, a complete sizing effect is attained in connection with the advantages specified by the invention.

The desired product is obtained in a pH-value range of 5 to 8, preferably 6 to 8. The reduction of the pH-value to values less than 5 leads to a deterioration of the sizing and is expressed, for example, by a deeper penetration of the bath into the paper during the photographic process. An increase in the pH-value to values above 8 leads to a flocculation of the aluminum ions as aluminum hydroxide.

Several aluminum salts can be used as agents for the aluminum ions, such as for example, aluminum sulfate, aluminum chloride, aluminum nitrate, aluminum lactate, aluminum formiate, sodium aluminate, or potassium aluminum sulfate.

It is to be particularly emphasized that the product in accordance with the invention can only be attained through the addition of aluminum compounds to reactively sized paper supports. Other cations, such as, for example, tin, zinc, zirconium, magnesium, calcium, sodium, boron, and silicon ions do not effect the advantages in accordance with the invention.

The invention will now be illustrated in greater detail by means of the following examples.

EXAMPLE 1 (Comparative Example)

For the production of a paper support having a basis weight of approximately 160 g/m$^2$, the paper stuff was sized with 0.6 weight % of alkylketenedimer and 1.2 weight % of wet-strength agent in the neutral pH-range. The finished base paper was coated on one side with a hardenable mixture with the following composition:

40 weight % polyesteracrylate ($\overline{M}$=ca. 1000, 4 double bonds on MG);

40 weight % hexanedioldiacrylate;

20 weight % trimethylolpropanetriacrylate.

The coating weight applied amounted to approximately 20 g/m$^2$. The coating was subsequently hardened, under nitrogen, by means of electron beams using an energy dose of 4 Mrad.

EXAMPLE 2

For the production of a paper support having a basis weight of approximately 160 g/m$^2$, the paper stuff was sized with 0.6 weight % of alkylketenedimer and 1.2 weight % of wet strength agent in the neutral pH-value range. Sheets were produced from the paper stuff, to which the following quantities of aluminum ions, in the form of aluminum sulfate, were added:

| | |
|---|---|
| 2a | 0.1 weight % |
| 2b | 0.3 weight % |
| 2c | 0.5 weight % |
| 2d | 0.7 weight % |
| 2e | 1.0 weight % |
| 2f | 1.2 weight % |

The base papers produced from these were coated on one side with the hardenable layer described in example 1. The coating weight applied amounted to approximately 20 g/m$^2$. The coating was hardened, under nitrogen, by means of electron beams, using an energy dose of 4 Mrad.

EXAMPLE 3

For the production of a paper support having a basis weight of approximately 160 g/m$^2$, a paper stuff was sized with 0.6 weight % of alkylketenedimer and 1.2 weight % of wet strength agent in the neutral pH-range. Sheets were made from this paper stuff, to which the following aluminum salts were added:

| | | |
|---|---|---|
| 3a | $AlCl_3$ | (0.2 weight % aluminum ions) |
| 3b | $AlCl_3$ | (0.6 weight % aluminum ions) |
| 3c | Aluminum lactate | (0.2 weight % aluminum ions) |
| 3d | Aluminum lactate | (0.6 weight % aluminum ions) |
| 3e | $Al(NO_3)_3$ | (0.2 weight % aluminum ions) |
| 3f | $Al(NO_3)_3$ | (0.6 weight % aluminum ions) |
| 3g | $NaAlO_2$ | (0.2 weight % aluminum ions) |
| 3h | $NaAlO_2$ | (0.6 weight % aluminum ions) |
| 3i | $KAl(SO_4)_2$ | (0.2 weight % aluminum ions) |
| 3j | $KAl(SO_4)_2$ | (0.6 weight % aluminum ions) |

The base papers thus obtained were coated on one side with the hardenable layer described in example 1. The coating weight applied amounted to approximately 20 g/m$^2$. The coating was hardened, under nitrogen, by means of electron beams, using an energy dose of 4 Mrad.

EXAMPLE 4

For the production of a paper support having a basis weight of approximately 160 g/m$^2$, a paper stuff was sized with 0.6 weight % of alkylketenedimer and 1.2 weight % of wet strength agent. Sheets were made from this stock after adjusting the pH-values by adding either aluminum sulfate or aluminum chloride, and if necessary NaOH or $H_2SO_4$. (The weight % quantities indicated in the table relate to the content of aluminum ions):

| | | |
|---|---|---|
| 4a | 0.6 weight % $Al_2(SO_4)_3$ | pH = 4.6 |
| 4b | 0.6 weight % $Al_2(SO_4)_3$ | pH = 4.8 |
| 4c | 0.6 weight % $Al_2(SO_4)_3$ | pH = 5.2 |
| 4d | 0.6 weight % $Al_2(SO_4)_3$ | pH = 6 |
| 4e | 0.6 weight % $Al_2(SO_4)_3$ | pH = 6.5 |
| 4f | 0.6 weight % $Al_2(SO_4)_3$ | pH = 7 |
| 4g | 0.6 weight % $Al_2(SO_4)_3$ | pH = 7.5 |
| 4h | 0.6 weight % $Al_2(SO_4)_3$ | pH = 8 |
| 4i | 0.6 weight % $Al_2(SO_4)_3$ | pH = 8.5 |
| 4j | 0.6 weight % $Al_2(SO_4)_3$ | pH = 9 |
| 4k | 0.6 weight % $AlCl_3$ | pH = 4.6 |
| 4l | 0.6 weight % $AlCl_3$ | pH = 4.8 |
| 4m | 0.6 weight % $AlCl_3$ | pH = 5.2 |
| 4n | 0.6 weight % $AlCl_3$ | pH = 6 |
| 4o | 0.6 weight % $AlCl_3$ | pH = 6.5 |
| 4p | 0.6 weight % $AlCl_3$ | pH = 7 |
| 4q | 0.6 weight % $AlCl_3$ | pH = 7.5 |
| 4r | 0.6 weight % $AlCl_3$ | pH = 8 |
| 4s | 0.6 weight % $AlCl_3$ | pH = 8.5 |
| 4t | 0.6 weight % $AlCl_3$ | pH = 9 |

The base papers thus obtained were coated on one side with the hardenable layer described in example 1. The coating applied was hardened, under nitrogen, by means of electrons, using an energy dose of 4 Mrad.

EXAMPLE 5

For production of a paper support having a basis weight of approximately 160 g/m$^2$, a paper stuff was sized with 0.6 weight % of alkylketenedimer and 1.0 weight % of wet strength agent in the neutral range. From this paper stuff, sheets were produced with the following additives:

| | |
|---|---|
| 5a | 0.6 weight % $Al_2(SO_4)_3$ (relative to $Al^{3+}$) |
| | 0.5 weight % anionic polyacrylamide; |
| 5b | 0. weight % $Al_2(SO_4)_3$ relative to $Al^{3+}$) |
| | 0.5 weight % anionic polyacrylamide |
| | 0.1 weight % epoxidized fatty acid amide; |
| 5c | 0.6 weight % $Al_2(SO_4)_3$ (relative to $Al^{3+}$) |
| | 0.5 weight % cationic polyacrylamide; |
| 5d | 0.6 weight % $Al_2(SO_4)_3$ (relative to $Al^{3+}$) |
| | 0.5 weight % cationic polyacrylamide |
| | 0.1 weight % epoxidized fatty acid amide; |
| 5e | 0.6 weight % $Al_2(SO_4)_3$ (relative to $Al^{3+}$) |
| | 0.1 weight % epoxidized fatty acid amide. |

The base papers thus obtained were coated on one side with the hardenable layer described in example 1. The coating applied was hardened, under nitrogen, by means of electron beams, using an energy dose of 4 Mrad.

EXAMPLE 6

For the production of a paper support having a basis weight of approximately 160 g/m$^2$, the paper stuff was sized with 0.8 weight of alkylketenedimer and 1.5 weight % of wet strength agent, in the neutral range.

After drying the base paper to a residual moisture content of approximately 22%, it was provided with a surface impregnation by means of a spraying process.

The solution used for the surface impregnation had the following composition:

20 g/l Starch
15 g/l NaCl
10 g/l $Na_2SO_3$
20 g/l $Na_2S_2O_5$
80 g/l Al-lactate Of this solution, 50 g/m$^2$ (0.56 weight % of Al-ions) were absorbed by the base paper.

After the final drying and finishing, the base paper was coated on one side with the hardenable layer described in example 1. The coating weight applied amounted to approximately 20 g/m$^2$. The coating was hardened, under nitrogen, by means of electron beams, using an energy dose of 4 Mrad.

EXAMPLE 7

For the production of a paper support having a basis weight of approximately 160 g/m$^2$ the paper stuff was sized with 0.8 weight % of alkylketenedimer and 1.5 weight % of wet strength agent, in the neutral pH-range.

The base paper obtained therefrom was provided, by using two horizontal size presses positioned one above the other, with a surface impregnation. The positioning during the impregnation was such that the upper size press had a narrow aperture in order to allow passage of the base paper, which was provided with a thin fluid film, and that the lower size press was closed to act as a stripping device for the superfluous impregnation solution.

The solution used for the surface impregnation had the following composition:

20 g/l Starch
100 g/l White pigment (Anatase)
15 g/l NaCl
15 g/l $Na_2SO_3$
10 g/l $Na_2S_2O_5$
100 g/l Al-lactate
35 g/m$^2$ of this solution (0.33 weight % of Al-ions) was absorbed by the base paper.

After final drying and finishing, the base paper was coated on one side with the hardenable mixture described in example 1. The coating weight applied amounted to approximately 20 g/m$^2$. The coating was hardened, under nitrogen, by means of electron beams, using an energy dose of 4 Mrad.

TESTING THE SUPPORT MATERIALS

The influence of different support materials on the occurrence of fog in photographic layers was determined by inserting a sample of each specimen coated with irradiationhardened layers between two sheets of commercially available, light-sensitive silver halide paper, and then storing the same in the dark for 6 days at 50° C. and 40% relative humidity. In this contact test, the sheets were exposed to a pressure stress of approximately 300 g/m$^2$.

After the 6-day contact test, the test specimens were removed, and the photographic papers which had been in contact with the specimens were exposed to an average gray tone and developed.

The surfaces which had been in contact with the test specimens as well as the surrounding surfaces were densitometrically measured. Table 1 shows the difference, ΔD, of both values, which signifies the darkening of the gray tone through the contact with the test sheets.

This table demonstrates that, as claimed in the invention, the addition of aluminum ions to the paper stuff or paper sheet can almost prevent the fog caused by electron beams with a paper sized by reactive sizing agents if using this paper as photographic support material.

From table 2 it is clear that the values for the reference numbers 4a to 4h, which lie in the pH-value range specified by the invention, had slight penetration of the baths. The depth of bath penetration is greater with pH-values lower than 5.

TABLE 1

| Densitometric Test Results: | | | |
|---|---|---|---|
| Specimen number | ΔD | Specimen number | ΔD |
| 1 | 0.65 | 4a | 0.09 |
| (Comparison) | | 4b | 0.06 |
| | | 4c | 0.05 |
| 2a | 0.25 | 4d | 0.04 |
| 2b | 0.11 | 4e | 0.04 |
| 2c | 0.07 | 4f | 0.04 |
| 2d | 0.03 | 4g | 0.03 |
| 2e | 0.02 | 4h | 0.02 |
| 2f | 0.03 | 4i | 0.02 |
| | | 4j | 0.03 |
| | | 4k | 0.12 |
| | | 4l | 0.09 |
| 3a | 0.12 | 4m | 0.09 |
| 3b | 0.06 | 4n | 0.08 |
| | | 4o | 0.07 |
| | | 4p | 0.06 |
| 3c | 0.19 | 4q | 0.06 |
| 3d | 0.11 | 4r | 0.05 |
| | | 4s | 0.06 |
| | | 4t | 0.07 |
| 3e | 0.21 | | |
| 3f | 0.08 | | |
| | | 5a | 0.02 |
| | | 5b | 0.02 |
| 3g | 0.37 | 5c | 0.03 |
| 3h | 0.31 | 5d | 0.03 |
| | | 5e | 0.04 |
| 3i | 0.19 | | |
| 3j | 0.17 | 6 | 0.06 |
| | | 7 | 0.10 |

TABLE 2

| Bath Pentration (Example 4) | |
|---|---|
| 4a | 1.0 mm |
| 4b | 0.9 mm |
| 4c | 0.7 mm |
| 4d | 0.6 mm |
| 4e | 0.6 mm |
| 4f | 0.6 mm |
| 4g | 0.6 mm |
| 4h | 0.6 mm |
| 4i | 0.6 mm |
| 4j | 0.6 mm |
| 4k | 1.1 mm |
| 4l | 1.0 mm |
| 4m | 0.8 mm |
| 4n | 0.7 mm |
| 4o | 0.7 mm |
| 4p | 0.7 mm |
| 4q | 0.7 mm |
| 4r | 0.7 mm |
| 4s | 0.7 mm |
| 4t | 0.7 mm |

The effect in accordance with the invention is not restricted to the use of the aluminum cations in the paper stuff in accordance with the examples stated. It can also be attained by the additional impregnation of a paper sized with reactive sizing agents, by means of a surface coating containing aluminum ions as described in example 6.

We claim:

1. A water-resistant photographic paper support comprising a base paper with at least one coating on said base paper hardened by electron beams, said coating including an electron beam hardenable polymer derived from acrylate or methacrylate monomers, said base paper including a reactive sizing agent in the absence of an unreactive sizing agent selected from the group consisting of alkyl ketene diner, epoxidized higher fatty acid amide and mixture thereof, said reactive sizing agent present in an amount sufficient to reduce penetration of a developing bath at edges of the paper support, said base paper containing at least one aluminum compound, the aluminum ion in said compound being present in a quantity of about 1 to 12 kg/t of the cellulose in said base paper, and the pH-value of the base paper stuff is between about 5 and 8.

2. The paper support of claim 1, wherein said base paper contains said aluminum ion in a quantity of about 3 to 6 kg/t of the cellulose.

3. The paper support of claim 1, wherein the pH-value of the base paper stuff is between about 6 to 8.

4. The paper support of claim 2, wherein the pH-value of the base paper stuff is between about 6 to 8.

5. The paper support of claim 1, wherein the aluminum ions are added to the base paper in the form of aluminum salts.

6. The paper support of claim 2, wherein the aluminum ions are added to the base paper in the form of aluminum salts.

7. The paper support of claim 1, wherein said aluminum compound is an inorganic aluminum salt.

8. The paper support of claim 2, wherein said aluminum compound is an inorganic aluminum salt.

9. The paper support of claim 1, including additional wet-strength agents, retention aids, white pigments, color pigments, or optical brighteners in the base paper.

10. The paper support of claim 2, including additional wet-strength agents, retention aids, white pigments, color pigments, or optical brighteners in the base paper.

11. The paper support of claim 15, wherein said base paper contains said aluminum ion in a quantity of about 3 to 6 kg/t of the cellulose.

12. The paper support of claim 11, wherein the pH-value of the base paper stuff is between about 6 to 8.

13. The paper support of claim 15, wherein, the pH-value of the base paper stuff is between about 6 to 8.

* * * * *

UNITED STATES PATENT AND TRADEMARK OFFICE

CERTIFICATE OF CORRECTION

PATENT NO. : 4,844,777

DATED : July 4, 1989

INVENTOR(S) : Anthonsen et al.

It is certified that error appears in the above-identified patent and that said Letters Patent is hereby corrected as shown below:

In the Claims:

In claim 1, col. 7, line 12, delete "alkyl ketene diner" and insert -- alkylketene dimer --.

In claim 1, col. 7, line 13, delete "mixture" and insert -- mixtures --.

Signed and Sealed this

Twenty-third Day of April, 1991

*Attest:*

HARRY F. MANBECK, JR.

*Attesting Officer*

*Commissioner of Patents and Trademarks*